US006478081B1

(12) United States Patent
Shaw

(10) Patent No.: US 6,478,081 B1
(45) Date of Patent: Nov. 12, 2002

(54) PLATE HEAT EXCHANGER

(75) Inventor: Jonathan Graham Shaw, Goldsboro, NC (US)

(73) Assignee: APV North America Inc., Rosemont, IL (US)

( * ) Notice: Subject to any disclaimer, the term of this patent is extended or adjusted under 35 U.S.C. 154(b) by 0 days.

(21) Appl. No.: 09/368,126

(22) Filed: Aug. 4, 1999

(51) Int. Cl.[7] ..... F28F 3/00
(52) U.S. Cl. ..... 165/167; 165/DIG. 365
(58) Field of Search ..... 165/167, 166

(56) References Cited

U.S. PATENT DOCUMENTS 3,735,793 A * 5/1973 Burberry et al. ..... 165/167 X
5,203,406 A * 4/1993 Blomgren et al. ..... 165/167
5,435,383 A * 7/1995 Rajagopal ..... 165/167
5,509,471 A * 4/1996 Hallgren ..... 165/167
5,522,462 A * 6/1996 Kumar et al. ..... 165/167 X

FOREIGN PATENT DOCUMENTS

WO 95 00810 1/1995
WO 97/15797 5/1997

* cited by examiner

*Primary Examiner*—Leonard Leo
(74) *Attorney, Agent, or Firm*—Michael D. Rechtin; Foley & Lardner

(57) ABSTRACT

A plate heat exchanger comprising a stack of heat transfer plates which together with sealing means define first and second flow passages for first and second fluids respectively. The heat transfer plates are formed with through holes defining an inlet channel communicating with the first flow passages and a gasket is arranged around the through holes in the gap between each pair of heat transfer plates forming a first flow passage. The gasket can be inserted in and/or removed from the gap between a pair of permanently joined heat transfer plates and can include a tube for producing a pressure drop for flow of fluid from the inlet passage to the first flow passage.

38 Claims, 5 Drawing Sheets

PLATE HEAT EXCHANGER

BACKGROUND OF THE INVENTION

The present invention relates to a plate heat exchanger. More particularly, the invention concerns a plate heat exchanger consisting of a stack of heat transfer plates provided with through inlet ports forming an inlet channel through the stack and, between the heat transfer plates, sealing means which together with the heat transfer plates in every other plate interspace delimit a first flow passage for one fluid and, in each remaining interspace, delimit a second flow passage for another fluid, wherein the inlet channel connects with each first flow passage by means of at least one inlet passage and is prevented from entry to the second flow passage(s) by sealing means which is located in a primary sealing area around each respective inlet port.

Typically, such plate heat exchangers have equally sized inlet and outlet ports for single phase heat exchange because the fluid density changes relatively little along the heat transfer channel connecting inlet to outlet ports.

In two phase heat transfer during evaporation or condensation, a transition from liquid to gas occurs resulting in very large density changes wherein the inlet and outlet velocities differ greatly. The different velocities produce different pressure drops along the through inlet ports with respect to the flow outlet ports from the stack of heat transfer plates.

Further, in the process of evaporation, dynamic boiling instabilities can result when produced vapor is able to displace liquid accumulated within an inlet port. This displaced liquid can enter the heat transfer passage and produce a transient over feed of the evaporating liquid. This transient over feed can produce control difficulties in many compact forms of heat exchangers where the liquid hold up capacity within the stack of plates is relatively small in relation to that of the inlet channel.

Additional problems of ensuring that each first flow passage is fed with an equal rate of evaporating fluid from the inlet port occurs when this fluid consists of two phases not one. Not only is it important to produce equal mass distribution but also to ensure equal phase distribution. This, however, is much more difficult to ensure yet, for evaporation, equal distribution of the inlet liquid phase to each first flow passage is crucial to ensure optimum heat transfer performance.

In a previous U.S. Pat. No. 3,735,793, a means of flow distribution down a flow port was conceived in which a large pressure drop was created, compared to along the inlet or outlet port, into each plate pair by means of providing each plate with a small diameter feed hole compared to the diameter of the inlet or outlet port. In this way, the feed rate into any plate pair is largely controlled mainly by the pressure loss through the small hole and not by the feed pressure minus passage and outlet port pressure loss.

Prior art as described in Swedish patent application 8702608-4 produces restrictive means into each plate pair from the inlet port using a ring or washer which is positioned around the feed port and through which flow is delimited by means of a cut, slot or drilled hole through this ring so producing a pressure drop creating orifice. These devices have not proven satisfactory for two main reasons. One, the high cost of production and two, the ring or washer is permanently bonded between the plate pair at the time of manufacture and has to be very accurately aligned so as not to interfere with the joining process which creates the plate pair.

The other major disadvantage is that the plate pair created completely encloses the pressure drop creating device which, once enclosed, can not be adjusted to compensate for changing process requirements, for example increased flow rates or changes in process fluids.

SUMMARY OF THE INVENTION

The present invention has been made from a consideration of the problems and disadvantages of the known heat exchangers aforementioned.

The purpose of this invention is to obtain a well defined pressure drop creating opening from the feed port into the plate passages.

A more preferred purpose of the invention is to provide a construction in which such pressure drop creating opening can be easily altered without changing the manufacturing process of the metal heat exchange plates.

The invention broadly consists in the heat transfer plates forming the first flow passage having a gasket arranged therebetween around the respective inlet ports.

Preferably, the gasket is not fully enclosed by the plates in the direction leading back into the inlet channel. In this way, the gasket remains accessible from this direction for removal or refit between a pair of plates even when the plates have been permanently joined together by a weld or braze in the primary sealing area.

Advantageously, the inlet passage is delimited by means of at least one of the heat transfer plates and/or by means for fluid to communicate directly through the gasket.

In one arrangement, the inlet passage is formed by a tube which extends through the gasket and provides pressure drop producing means connecting the inlet channel to the first flow passage. In this way, the pressure drop producing means can be adjusted by substituting different gasket/tube assemblies.

This design provides a much more flexible means to accommodate process changes without resorting to the re-manufacture of the expensive thermal plate pairs and, by standardizing the manufacture of the most costly components, namely the plates themselves, reduces overall manufacturing costs.

Previous art which uses a small orifice hole or pressed channel to effect a large pressure drop does not necessarily ensure equal phase distribution to all plate pairs along a feed port unless the feed is considered to act like a homogenous single phase.

The two phase feed to an evaporator will often not be homogenous but can be stratified due to a gas buoyancy effect with the result that plates will be fed with a different gas to liquid ratio at the entrance to the feed port than at the end of the feed port.

To facilitate correct gas distribution to each channel when the feed becomes stratified, the entrance to the pressure drop device must be a function of the plate pair position along the feed port. Each plate pair must thus differ from each other for optimum performance and can no longer be standardized provided the pressure drop means is made part of the thermal plates. The use of a separate component to provide the pressure drop means is beneficial for good operation.

Furthermore, the ability to access the pressure drop producing means externally has many advantages over that of designs employing a fixed means enclosed within the plate pair and produced by some plate feature i.e. hole or pressure detail. These advantages include:

1. If the pressure drop creating means should become blocked it may be easily accessed and cleaned.

2. If the pressure drop creating means becomes worn or damaged it can be simply replaced.
3. If the thermal duty changes then the pressure drop can be easily adjusted to suit by fitting a new gasket component.
4. The position and design of the pressure drop creating means can be varied with respect to position of any given plate pair within an operating plate stack so as to optimize two phase flow distribution.

The invention will now be described in detail in the following with references to the below drawings.

DETAILED DESCRIPTION OF THE EXEMPLARY EMBODIMENTS

Figure 1:
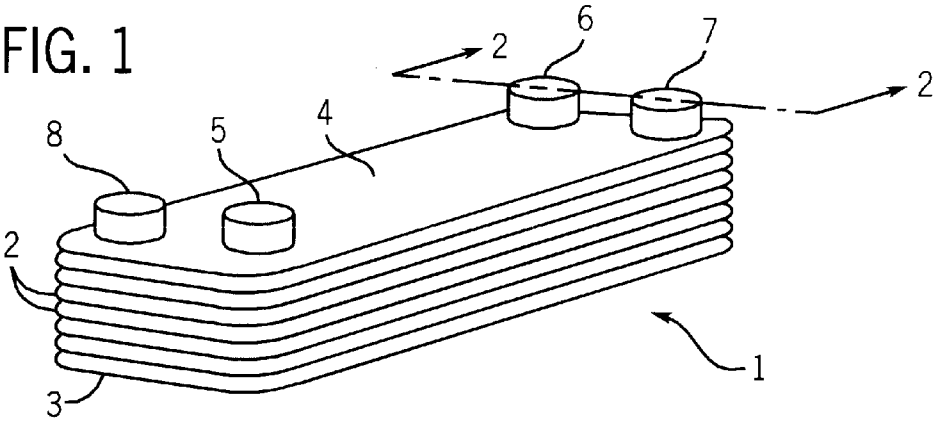
FIG. 1 shows a perspective view of a plate heat exchanger.

In FIG. 1, a plate heat exchanger (1) is shown, comprising a stack of heat transfer plates (2) and outer cover plates (3) and (4) which are arranged on the under and upper side, respectively, of the stack. The plate heat exchanger (1) has a first inlet (5) and a second inlet (6), and a first outlet (7) and a second outlet (8) for two heat transfer fluids.

Figure 2:
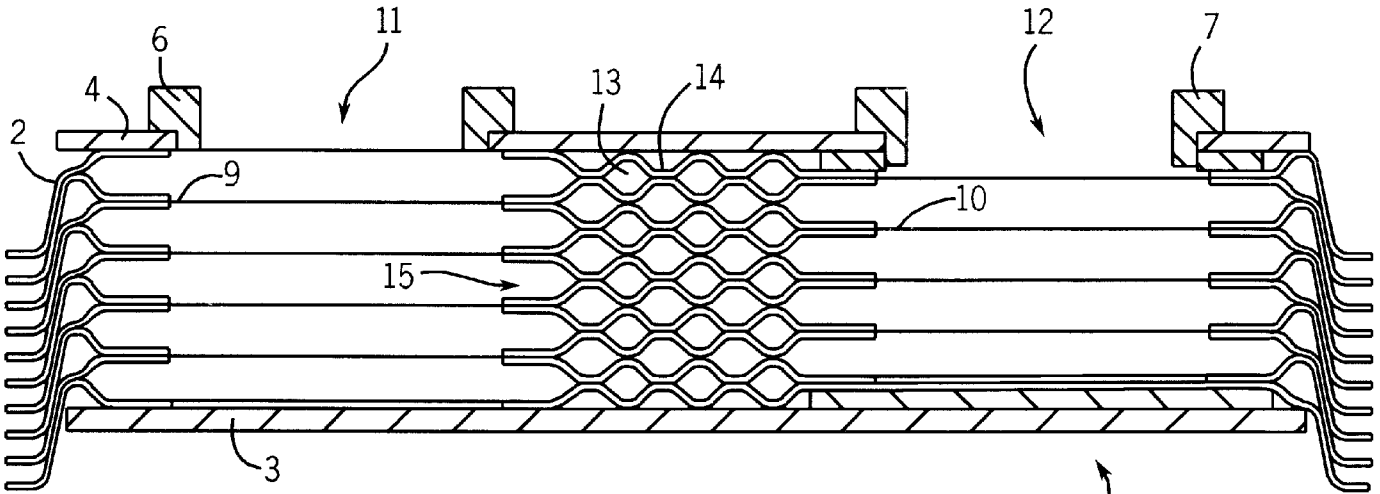
FIG. 2 shows a cross section through a conventional plate heat exchanger along the line A—A in FIG. 1.

In FIG. 2, a cross section through the plate heat exchanger (1) of FIG. 1 is shown, extending along the part of the exchanger comprising the second inlet port (6) and the first outlet port (7).

The stack shown in FIG. 2 consists of ten heat transfer plates (2) which are arranged on top of each other and are sandwiched between the upper (3) and lower (4) cover plates. The number of plates incorporated into any stack can be adjusted to match the thermal duty desired.

The heat transfer plates (2) are provided with through ports (9) and (10). The ports (9) and (10) are located in line with each other such that the ports (9) form an inlet channel or header (11) through the stack and the ports (10) form an outlet channel or header (12) through the stack. Both of the channels (11) or (12) are delimited at their ends by either the cover plate (3) or by the plate pair adjacent to this cover plate having no through ports (9) or (10) as shown in FIG. 2. The inlet channel (11) is connected to the inlet port (6) and the outlet channel (12) is connected to the outlet port (7).

The plate heat exchanger (1) is shown in the normal configuration according to current state of the art and is provided with some form of sealing means between the heat transfer plates (2) which, together with the heat transfer plates (2) in every other plate interspace, delimits a first flow passage (13) for one transfer fluid and, in the adjacent plate interspace, delimits a second flow passage for a different transfer fluid.

All adjacent plates are formed with pressed corrugations (14) which cross or abut to define and maintain the geometry of the first and second flow passage, even when high differential hydraulic pressures exist in adjacent first and second flow passages.

The first flow passage (13) is connected to the inlet channel (11) by way of at least one inlet passage (15) arranged between the ports (9) of two adjacent and abutting heat transfer plates (2).

The plate heat exchanger (1) is provided with one inlet channel (11) and one outlet channel (12) for each of the two heat transfer fluids, which inlet and outlet channels are located in the end portions of the rectangular heat transfer plates (2). Any number of inlet or outlet channels can be provided into any plate pair and of course plates need not be of rectangular geometry.

The plate heat exchanger (1) can be provided with semi-permanent sealing means such as gaskets or can be permanently sealed by means of solder, braze or welding. FIG. 1 shows a typical fully brazed or welded form of construction in which sealing means is effected by closely abutting plates along sealing areas and fusing parent metal or braze metal in the narrow interspace between abutting plates.

In the case where gaskets are used to effect seals, then the whole plate stack assembly is clamped together using tie bolts passing through the top (3) and bottom (4) cover plates.

Up to this point the detailed description above refers only to prior plate heat exchanger art.

Figure 3:
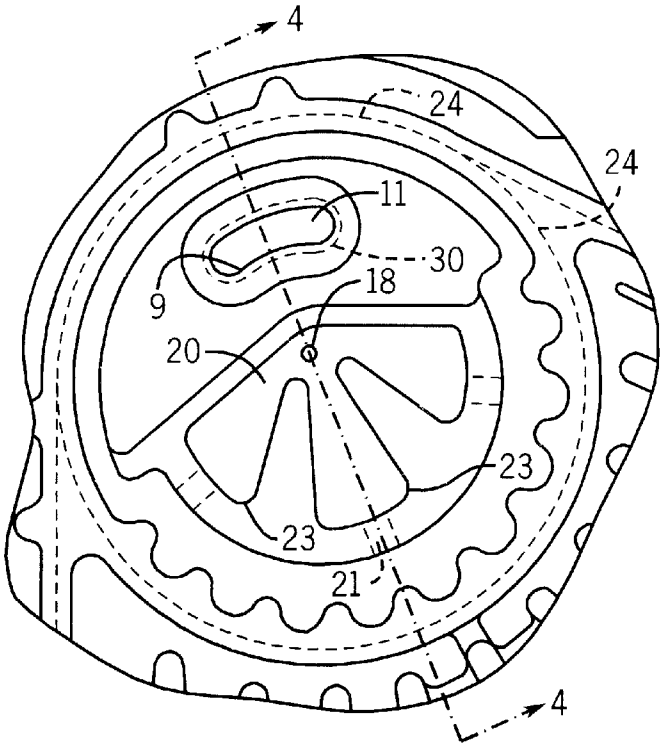
FIG. 3 shows a plan view across the feed port of a plate heat exchanger according to a first embodiment of the invention.
Figure 4:
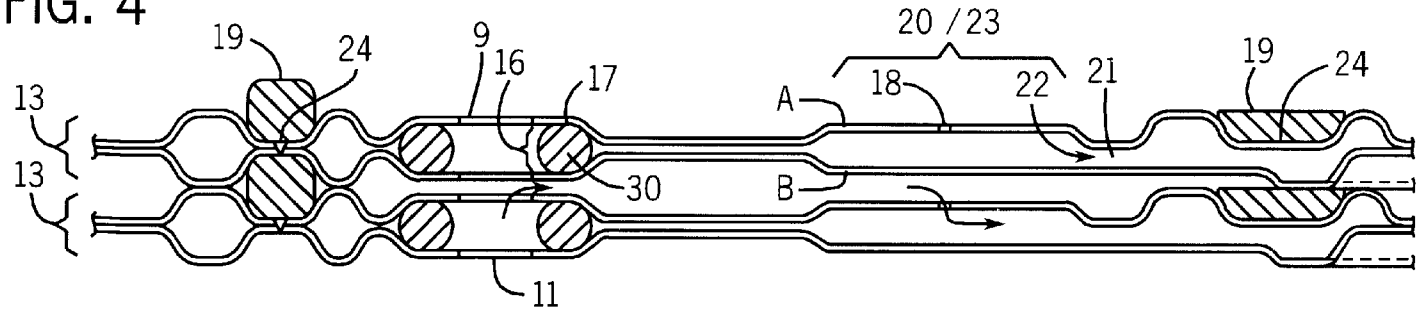
FIG. 4 shows a partial cross section through the plate heat exchanger according to the first embodiment of the invention along the line B—B of FIG. 3.

In FIG. 3 the first embodiment of the invention is shown. The heat transfer plates (2) are provided with a smaller inlet channel (11) and reduced perimeter port (9) compared to that of conventional plates. The port (9) is sealed by a gasket (30) running around its perimeter in secondary sealing area (17) and enclosed in a gap (16) formed between the heat transfer plates (2) that constitute the first flow passage (13).

The plates (2) do not abut around the port perimeter so that the interspace gap (16) around the port (9) and sealed by gasket (30) in-between the first flow passage (13) can be made semi rigid in nature so allowing the gasket (30) to be inserted into the gap (16) between the two plates even after the adjacent heat transfer plates (2) making up the first flow passage (13) have been permanently affixed to each other by welding in primary sealing area (24).

Successive first flow passages (13) each constituting a welded pair or cassette of plates are stacked one on top of another to produce the plate stack with each first flow passage (13) being sealed to the adjacent first flow passage (13) around the primary sealing area (24) by means of a gasket (19).

To effect a communication between the first flow passage (13) and the inlet channel (11), the respective flow channel

(15) in this first embodiment can be formed by one or more holes (18) through one or both plates that constitute the first flow passage (13) in the area outside of the secondary sealing area (17) but inside the primary sealing area (24).

In this first embodiment of the invention, the pressure drop producing means consists primarily of hole (18). The position, size and number of holes (18) can of course be varied to suit the heat transfer duty.

This inlet passage (15) opens into a lateral distribution interspace (20) formed from a pressed form in one or both of the plates which constitute the first flow channel (13). The perimeter around this interspace (20) is in close abutment between both the plates (A and B) forming the first flow passage (13) except in the location of a pressed channel (21) that communicates on into the first flow passage (13).

This pressed channel (21) forms a secondary pressure drop producing means which can be used to redirect flow laterally within the plane of the first flow passage (13). By changing the respective size and position of these pressed channels (21), the flow entering the interspace (20) via the inlet passage (15) can be split into two or more streams of equal or unequal flow rates as desired to effect good lateral distribution within the first flow passage (13).

Varying the size of channel (21) with respect to difference flow fingers (23) does little to influence the ratio of liquid to gas flow rates produced in lateral distribution but only the combined mixture feed rate in the direction of the distribution fingers (23).

In order to better control the split of liquid phase passing through hole (18) into the flow fingers (23), use is made of impingement of this liquid phase, which is much more dense than the gas phase, passing at high velocity through the small hole (18), onto the adjacent plate (B) beneath hole (18), onto the adjacent plate (B) beneath hole (18) in the distribution interspace (20).

Liquid phase flow proceeds radially away from the point of impact along plate B and will largely continue until this radial liquid flow becomes parted by the entrance into two or more distribution fingers (23), formed by the perimeter of interspace (20) and surrounding the hole (18).

Once the liquid phase passes through the entrance into the distribution fingers (23) it must emerge into the first flow passage (13) via the respective channel (21) at the end of the flow finger. Liquid flow backwards against the general flow direction is prevented by the high gas shear rate produced at the entrance to each flow finger (23).

By correctly positioning hole (18) with respect to the entrances to one or more flow fingers (23), the liquid phase entering through hole (18) can be redirected in any proportion desired and in any direction dictated by the flow fingers (23).

This design thus assures that the all important liquid phase is correctly distributed laterally over the first flow passage (13).

Figure 5:
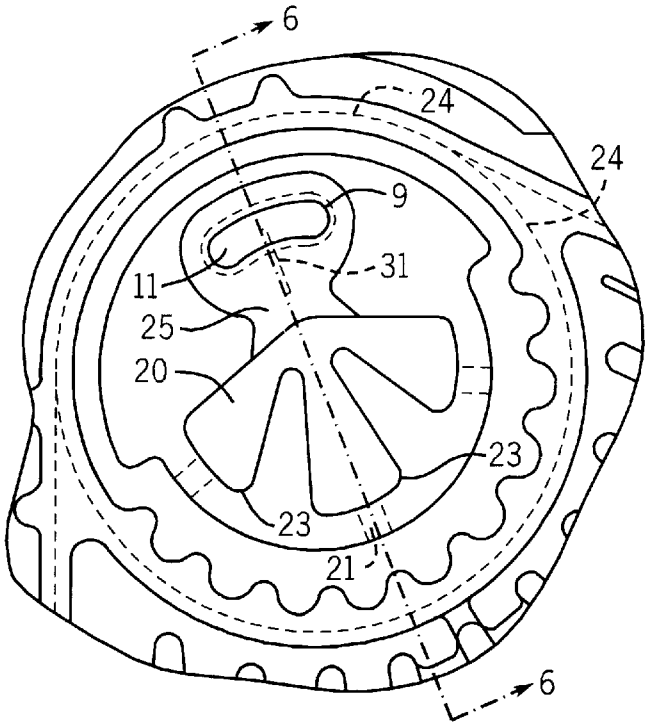
FIG. 5 shows a plan view across the feed port of a plate heat exchanger according to a second embodiment of the invention.
Figure 6:
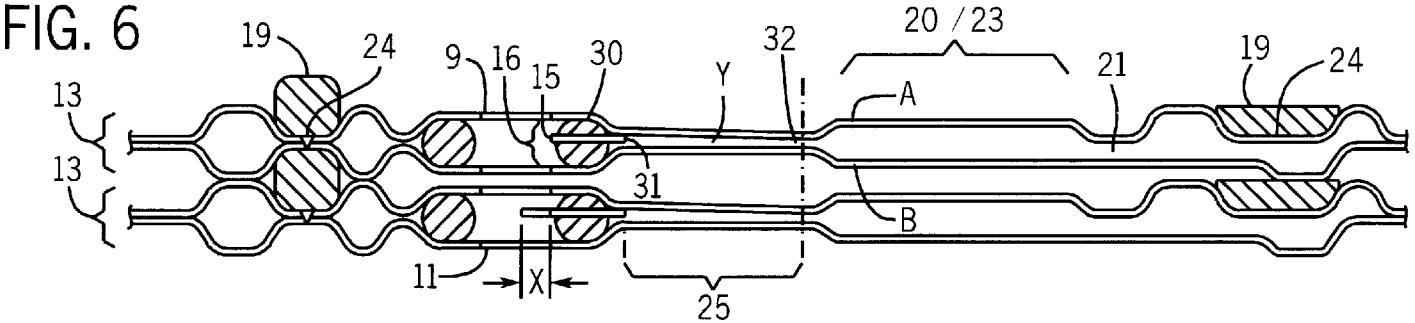
FIG. 6 shows a partial cross section through the plate heat exchanger according to the second embodiment of the invention along the line B—B of FIG. 5.

In FIGS. 5 and 6, the second embodiment of the invention is shown in which use is made of the secondary sealing gasket (30) to enclose and position a primary pressure drop producing means (31) in the form of a short length of small bore tubing which passes through the gasket to form the inlet passage (15). In this embodiment of the invention, the mixture flow rate, for any given pressure drop desired, through the inlet passage (15) into each first flow passage (13) from channel (11) can be altered by varying either the tube (31) diameter or tube length to suit the thermal duty.

Unlike the first embodiment of the invention, the proportion of liquid entering the distribution interspace (20) can be varied by changing the position of the entrance to the tube (31) within the inlet channel (11) with respect to the edge of the inlet port (9), i.e. dimension X can be varied.

Figure 7:
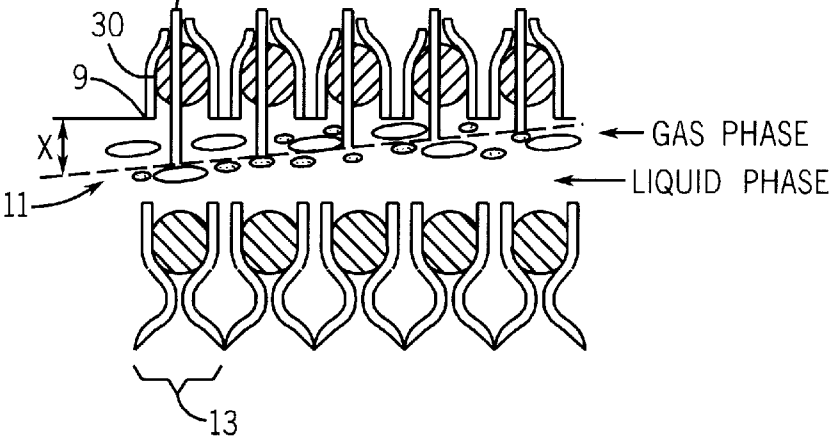
FIG. 7 shows a cross section through the inlet channel of the plate heat exchanger according to the second embodiment.

In FIG. 7 a section through the inlet port (9) is shown with the two phase mixture travelling from left to right into channel (11). If the two phase mixture were homogenous in nature, then the ratio between gas and liquid flow rates at any point in the channel (11) would be uniform and the flow rate through any pressure drop producing means would be dependant only on the geometry of said means and the pressure drop across the means.

However, due to buoyancy forces in the horizontal inlet channels (11), some phase separation occurs and the mixture becomes partially stratified, the gas phase concentrating in the upper half of the channel. If the ratio between gas and liquid phases entering any pressure drop producing means changes, then the rate of flow will also change if the pressure drop provided remains constant.

To ensure that the same feed rate into all first flow passages (13) is constant, then the gas to liquid ratio entering the means should also be constant. This second embodiment of the invention provides a means to accomplish this highly desired condition.

At some position x shown in FIG. 7 across the inlet channel (11) diameter, the ratio of gas to liquid phase is equal to the inlet gas to liquid ratio as fed to pipe (6). This position x is dependant on the distance of any first flow passage (13) in the stack as measured from the inlet pipe (6) or the length down the inlet channel (11) from the cover plate (3). This position x corresponds to the dotted line shown in FIG. 7.

The entrance to tube (31) within the feed channel (11) must be positioned at this location and will change slightly for each successive first flow passage (13). Changes in length x for each first flow passage (13) may be made in a continuous manner from cover plate (3) to cover plate (4) as shown by the locus of position x (dotted line) or may be approximated in a step wise manner.

The ability to easily adjust the pressure drop producing means by inserting a different gasket (30), tube (31) combination into any first flow passage (13) in the second embodiment of the invention means that an evaporator can be fine tuned for optimum distribution and thermal performance.

In this second embodiment of the invention, the high velocity jet of two phase mixture emerges from the outlet of the tube (31) and enters the interspace (20) in a direction roughly parallel to the plane of the first flow passage (13) so does not impact plate B of the first flow passage (13) in a perpendicular manner.

Liquid phase distribution in a lateral direction can not therefore be split into controlled proportions by virtue of the radial flow from a point of impact with plate B and instead use is made of a narrow gap expansion section (25) between the outlet of tube (31) and the entry into interspace (20).

This expansion section (25), by virtue of its narrow gap "y" and expanding fan shape, spreads the jet emerging from the outlet of the tube (31) into a fan like shape, the velocity of the mixture being maintained by a narrowing plate to plate gap as the flow width is increasing prior to entry into the interspace (20). In this manner, a high shear rate is maintained and the liquid spread evenly across the entire flow width of expansion section (25).

The entrance to the distribution fingers (23) formed by the perimeter of interspace (20) then parts this two phase flow into two or more directions. These distribution fingers (23) are used to direct the flow laterally into the first flow passage (13).

The third embodiment of the invention shown in FIGS. 8 and 9 again makes use of the secondary sealing gasket (30) to enclose and position a pressure drop producing means (31) in the form of a short length of small bore tubing which passes through the gasket (30) to form the inlet passage (15). In this embodiment, however, the outlet from the tube (31) does not directly enter an expansion section (25) but enters a redistribution or secondary inlet channel (26) formed by port (27).

This secondary inlet channel (26) communicates with all first flow passages (13) in the stack but is prevented by a sealing gasket (33) from communication with the second flow passage. The sealing gasket (33) is fitted between each pair of plates that constitute a first flow passage (13).

The secondary inlet channel (26) provides a redistribution stage to the process enabling any non-uniform feed rate that passes through any first pressure drop means (31) to be redistributed along channel (26) to one or more first flow passages (13) in the stack.

Figure 8:
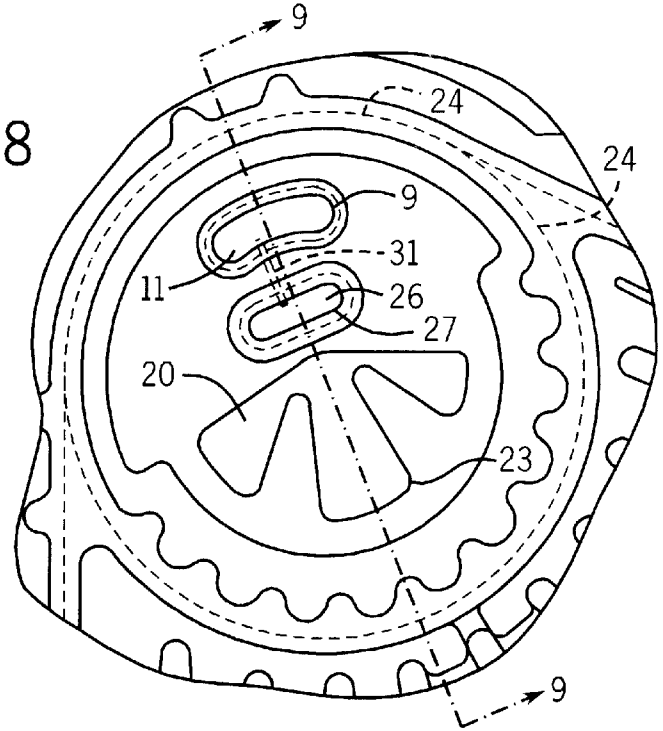
FIG. 8 shows a plan view across the feed port of a plate heat exchanger according to a third embodiment of the invention.
Figure 9:
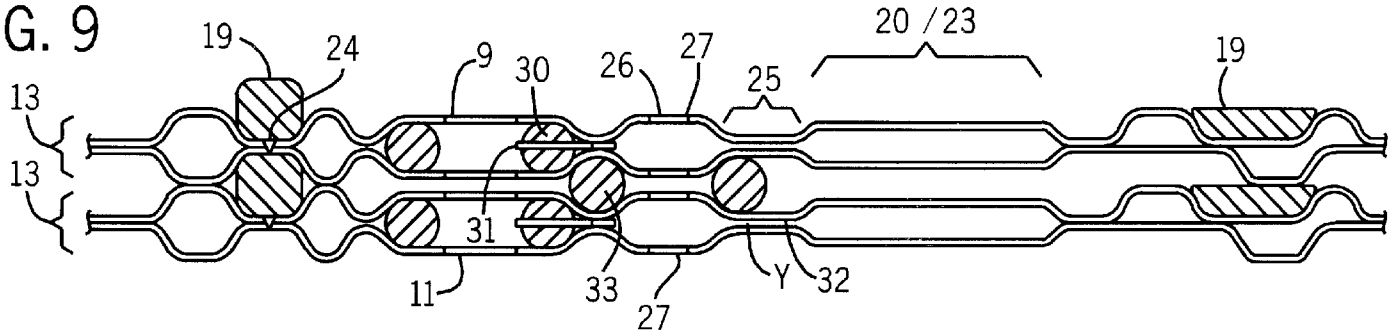
FIG. 9 shows a partial cross section through the plate heat according to the third embodiment of the invention along the line B—B of FIG. 8.
Figure 10:
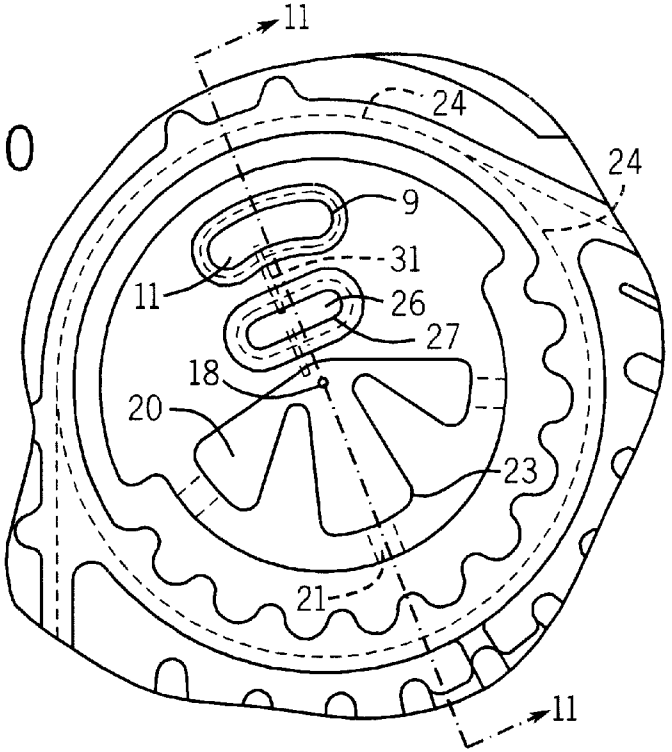
FIG. 10 shows a plan view across the feed port of the plate heat exchanger according to a fourth embodiment of the invention.
Figure 11:
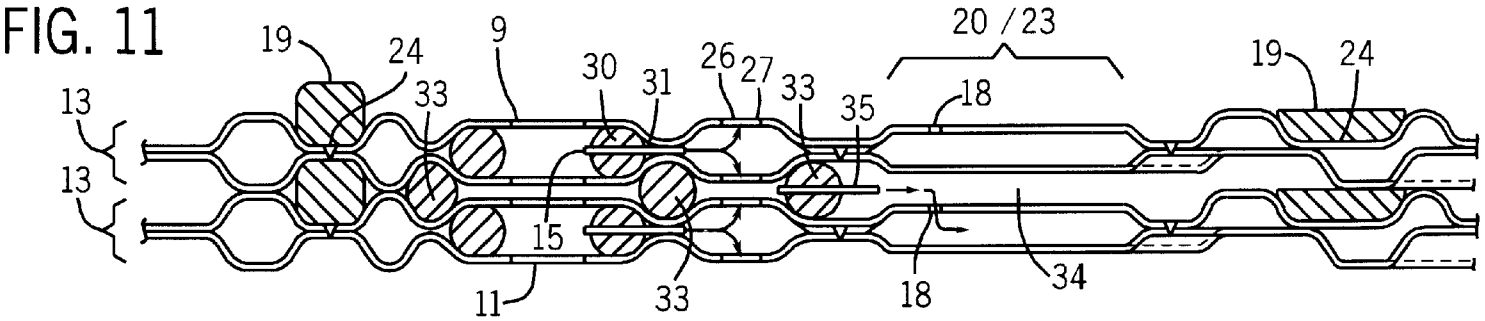
FIG. 11 shows a partial cross section through the plate heat exchanger according to the fourth embodiment of the invention along the line B—B of FIG. 10.

The fourth embodiment of the invention shown in FIGS. 10 and 11 is identical to that of the third embodiment except that the sealing gasket (33) takes the form of a FIG. 8 and seals around both the inlet channel (11) and the secondary inlet channel (26) and is fitted with a secondary pressure drop producing means (35) such as a tube passing through the sealing means around the secondary inlet channel (26).

This tube provides communication to the interspace (34) which lies between the primary sealing gasket (19) and the secondary sealing gasket (33) above or below the interspace (20).

To effect a communication between the first flow passage (13) and the interspace (34), use is made of the arrangement detailed in the first embodiment to provide communication into the interspace (20) by means of one or more holes (18) passing through one or both plates that constitute the first flow passage (13) in the area outside of the secondary sealing area produced at (17) and (33) inside the primary sealing area (24).

This fourth embodiment thus combines the distribution benefits detailed in the first, second and third embodiments of the invention.

As will be understood from the foregoing description of exemplary embodiments, the invention provides an arrangement in which a gasket is located in the gap between a pair of heat transfer plates and seals around the respective inlet ports of the plate pair. The arrangement is such that the gasket can be fitted in and removed from the gap even if the plates are bonded together to provide modular plate pairs. This has particular benefits when the pressure drop producing means is incorporated in the gasket itself, for example by a tube extending through the gasket, in allowing adjustments to be made by substituting different gasket/tube assemblies.

The invention also consists in a plate heat exchanger formed by a stack of heat transfer plate pairs, sealing means between adjacent plate pairs to delimit first and second flow passages for first and second fluids, the first flow passages communicating with an inlet channel formed by through holes in the plates, and each plate pair having an internal gasket arranged between the plates around the through holes such that the gasket can be fitted and removed with the plate pair joined together.

What is claimed is:

1. A plate heat exchanger comprising a stack of heat transfer plates which are provided with through inlet ports forming an inlet channel through said stack and, between said heat transfer plates, sealing means which together with said heat transfer plates in every other plate interspace delimit a first flow passage for a first fluid and, in each of the remaining plate interspaces, delimit a second flow passage for a second fluid, wherein said inlet channel communicates with each first flow passage by way of at least one inlet passage and is blocked from each second flow passage by sealing means which is located in a primary sealing area around each respective inlet port, wherein a gasket is detachably located directly between a pair of permanently joined heat transfer plates forming said first flow passage and seals around the respective inlet ports of said pair of permanently joined heat transfer plates.

2. A plate heat exchanger according to claim 1 wherein said inlet passage is delimited by at least one of said heat transfer plates.

3. A plate heat exchanger according to claim 1 wherein said inlet passage extends through said gasket.

4. A plate heat exchanger according to claim 1 wherein said inlet passage into said first flow passage is formed by providing a throttling means for the fluid in said inlet channel to pass through said gasket.

5. A plate heat exchanger according to claim 4 wherein said throttling means consists of a pressure drop producing device communicating through said gasket so as to produce an inlet passage connecting said first flow passage to said inlet port.

6. A plate heat exchanger comprising a stack of heat transfer plates which are provided with through inlet ports forming an inlet channel through said stack and, between said heat transfer plates, sealing means which together with said heat transfer plates in substantially every other plate interspace delimit a first flow passage for a first fluid and, in substantially each of the remaining plate interspaces, delimit a second flow passage for a second fluid, wherein said inlet channel communicates with each first flow passage by way of at least one inlet passage and is blocked from each second flow passage by sealing means which is located in a primary sealing area around each respective inlet port, said heat transfer plates forming said first flow passage having a gasket arranged therebetween around each respective inlet port, wherein the gasket is located in a gap between a pair of permanently joined heat transfer plates forming said first flow passage and seals around the respective inlet ports of said pair of heat transfer plates, and said gasket has a pressure drop producing device forming said inlet passage through said gasket.

7. A plate heat exchanger according to claim 6 wherein said inlet passage is delimited by at least one of said heat transfer plates.

8. A plate heat exchanger according to claim 6 wherein said inlet passage is formed by providing one or several holes through at least one of the plates that define said first flow passage.

9. A plate heat exchanger according to claim 8 wherein said inlet channel opens into an interspace which is enclosed within said primary sealing areas and is formed by the two plates that make up said first flow passage.

10. A plate heat exchanger according to claim 9 wherein said interspace has a perimeter shape defined where said two plates touch or abut that produces in the close proximity of said hole, the junction between two or more distribution fingers of which the other ends communicate into said first flow passage.

11. A plate heat exchanger according to claim 6 wherein the overall length of said pressure drop producing device can be varied with respect to the position of said first passage within the overall stack of heat transfer plates.

12. A plate heat exchanger according to claim 6 wherein the bore diameter of said pressure drop producing device can be varied with respect to the position of said first passage within the overall stack of heat transfer plates.

13. A plate heat exchanger according to claim 6 wherein the position of an inlet of said pressure drop producing device extending into said inlet channel can be varied with respect to the axis of said inlet channel.

14. A plate heat exchanger according to claim 13 wherein said position is varied with respect to the position of said first passage within said stack of heat transfer plates.

15. A plate heat exchanger according to claim 6, wherein the position of an outlet of said pressure drop producing device communicates into an expansion section which also communicates with said interspace.

16. A plate heat exchanger according to claim 15 wherein said expansion section has, by design, a plate to plate gap (y), as measured within said first flow passage, much smaller than the mean plate to plate separation between the two plates that delimit said first flow passage.

17. A plate heat exchanger according to claim 6 wherein said gasket is detachably located between a pair of permanently joined heat transfer plates.

18. A plate heat exchanger comprising a stack of heat transfer plates which are provided with through inlet ports forming an inlet channel through said stack and, between said heat transfer plates, sealing means which together with said heat transfer plates in substantially every other plate interspace delimit a first flow passage for a first fluid and, in substantially each of the remaining plate interspaces, delimit a second flow passage for a second fluid, wherein said inlet channel communicates with each first flow passage by way of at least one inlet passage and is blocked from each second flow passage by sealing means which is located in a primary sealing area around each respective inlet port, said heat transfer plates forming said first flow passage having a gasket arranged therebetween around the respective inlet ports, said inlet passage into said first flow passage formed by providing a throttling means for the fluid in said inlet channel to pass through said gasket, wherein the position of an outlet end of said throttling means communicates with a secondary inlet channel formed by a secondary port lying within the bounds enclosed by said primary sealing area.

19. A plate heat exchanger according to claim 18 wherein said secondary inlet channel provides communication into all first flow passages within a stack.

20. A plate heat exchanger according to claim 18 wherein said secondary inlet channel communicates into an expansion section which also communicates with said interspace.

21. A plate heat exchanger according to claim 20 wherein said expansion section has, by design, a plate to plate gap (y), as measured within said first flow passage, much smaller than the mean plate to plate separation between the two plates that delimit said first flow passage.

22. A plate heat exchanger according to claim 18 wherein said secondary inlet channel is prevented from communication with said second flow passage by a secondary sealing gasket and a secondary pressure drop producing means passes through said secondary sealing gasket to provide communication between said secondary inlet channel and an interspace within said stack.

23. A plate heat exchanger according to claim 18 wherein said inlet passage is delimited by at least one of said heat transfer plates.

24. A plate heat exchanger according to claim 18 wherein the overall length of said pressure drop producing device can be varied with respect to the position of said first passage within the overall stack of heat transfer plates.

25. A plate heat exchanger according to claim 18 wherein the bore diameter of said pressure drop producing device can be varied with respect to the position of said first passage within the overall stack of heat transfer plates.

26. A plate heat exchanger according to claim 18 wherein the position of an inlet end of said throttling means extending into said inlet channel can be varied with respect to the axis of said inlet channel.

27. A plate heat exchanger according to claim 26 wherein said position is varied with respect to the position of said first passage within said stack of heat transfer plates.

28. A plate heat exchanger according to claim 18 wherein the position of an outlet end of said throttling means o an expansion section which also communicates with said interspace.

29. A plate heat exchanger according to claim 28 wherein said expansion section has, by design, a plate to plate gap (y), as measured within said first flow passage, much smaller than the mean plate to plate separation between the two plates that delimit said first flow passage.

30. A plate heat exchanger according to claim 18 wherein said gasket is detachably located between a pair of permanently joined heat transfer plates.

31. A plate heat exchanger comprising a stack of heat transfer plates which are provided with through inlet ports forming an inlet channel through said stack and, between said heat transfer plates, sealing means which together with said heat transfer plates in substantially every other plate interspace delimit a first flow passage for a first fluid and, in substantially each of the remaining plate interspaces, delimit a second flow passage for a second fluid, wherein said inlet channel communicates with each first flow passage by way of at least one inlet passage and is blocked from each second flow passage by sealing means which is located in a primary sealing area around each respective inlet port, said heat transfer plates forming said first flow passage having a gasket arranged therebetween around each respective inlet port, wherein a gasket is located in a gap between a pair of permanently joined heat transfer plates forming said first flow passage and seals around the respective inlet ports of said pair of heat transfer plates, and said gasket has a pressure drop producing device forming said inlet passage through said gasket, and wherein said inlet passage extends through the gasket.

32. A plate heat exchange comprising a stack of heat transfer plates which are provided with through inlet ports forming an inlet channel through said stack and, between said heat transfer plates, sealing means which together with said heat transfer plates in substantially every other plate interspace delimit a first flow passage for a first fluid and, in substantially each of the remaining plate interspaces, delimit a second flow passage for a second fluid, wherein said inlet channel communicates with each first flow passage by way of at least one inlet passage and in blocked from each second flow passage by sealing means which is located in a primary sealing area around each respective inlet port, said heat transfer plates forming said first flow passage having a gasket arranged therebetween around the respective inlet ports, said inlet passage into said first flow passage formed by providing a throttling means for the fluid in said inlet channel to pass through said gasket, wherein the position of an outlet end of said throttling means communicates with a secondary inlet channel formed by a secondary port lying within the bounds enclosed by said primary sealing area, and wherein said inlet passage is formed by providing one or several holes through at least one of the plates that define said first flow passage.

33. A plate heat exchanger according to claim 32 wherein said inlet channel opens into an interspace which is enclosed within said primary sealing areas and is formed by the two plates that make up said first flow passage.

34. A plate heat exchanger according to claim 33 wherein said interspace has a perimeter shape defined where said two plates touch or abut that produces in the close proximity of said hole, the junction between two or more distribution fingers of which the other ends communicate into said first flow passage.

35. A plate heat exchanger comprising a stack of heat transfer plates which are provided with through inlet ports forming an inlet channel through said stack and, between said heat transfer plates, sealing means which together with said heat transfer plates in substantially every other plate interspace delimit a first flow passage for a first fluid and, in substantially each of the remaining plate interspaces, delimit a second flow passage for a second fluid, wherein said inlet channel communicates with each first flow passage by way of at least one inlet passage and is blocked from each second flow passage by sealing means which is located in a primary sealing area around each respective inlet port, said heat transfer plates forming said first flow passage having a gasket arranged therebetween around the respective inlet ports, wherein said inlet passage extends through said gasket into said first flow passage and is formed by providing a throttling means for the fluid in said inlet channel to pass through said gasket, and wherein the position of an outlet end of said throttling means communicates with a secondary inlet channel formed by a secondary port lying within the bounds enclosed by said primary sealing area.

36. A plate heat exchanger comprising a stack of heat transfer plates which are provided with through inlet ports forming an inlet channel through said stack and, between said heat transfer plates, sealing means which together with said heat transfer plates in substantially every other plate interspace delimit a first flow passage for a first fluid and, in substantially each of the remaining plate interspaces, delimit a second flow passage for a second fluid, wherein said inlet channel communicates with each first flow passage by way of at least one inlet passage and is blocked from each second flow passage by sealing means which is located in a primary sealing area around each respective inlet port, a gasket arranged between a pair of said heat transfer plates forming said first flow passage and sealing around the respective inlet ports of said pair of heat transfer plates, a throttling means forming said inlet passage through said gasket, wherein said throttling means has an inlet end communicating with said inlet channel and an outlet end communicating with a secondary inlet channel formed by a secondary port lying within the bounds enclosed by said primary sealing area.

37. The plate heat exchanger of claim 36, wherein said gasket is detachably located between the pair of heat transfer plates.

38. The plate heat exchanger of claim 36, wherein the pair of heat transfer plates are permanently joined together.

* * * * *